US007844201B2

(12) United States Patent
Hamasaki et al.

(10) Patent No.: US 7,844,201 B2
(45) Date of Patent: Nov. 30, 2010

(54) COLOR IMAGE FORMING APPARATUS AND COLOR IMAGE FORMING METHOD

(75) Inventors: Kazunari Hamasaki, Osaka (JP); Yuko Iwashita, Osaka (JP)

(73) Assignee: Kyocera Mita Corporation (JP)

( * ) Notice: Subject to any disclaimer, the term of this patent is extended or adjusted under 35 U.S.C. 154(b) by 196 days.

(21) Appl. No.: 12/173,831

(22) Filed: Jul. 16, 2008

(65) Prior Publication Data

US 2009/0028607 A1 Jan. 29, 2009

(30) Foreign Application Priority Data

Jul. 23, 2007 (JP) ..... 2007-190349

(51) Int. Cl.
*G03G 15/00* (2006.01)

(52) U.S. Cl. ..... 399/159

(58) Field of Classification Search ..... 399/149, 399/150, 159, 223, 252; 430/46.1, 56, 60, 430/69, 127
See application file for complete search history.

(56) References Cited

U.S. PATENT DOCUMENTS 3,998,987 A * 12/1976 Kirigaya et al. ..... 428/330
5,382,486 A * 1/1995 Yu et al. ..... 430/56
7,402,366 B2 * 7/2008 Hayata et al. ..... 399/159 X
7,428,395 B2 * 9/2008 Takahashi et al. ..... 399/149
2003/0185591 A1 * 10/2003 Furukawa et al. ..... 399/159
2003/0219664 A1 * 11/2003 Ohkura et al. ..... 430/75
2007/0092296 A1 * 4/2007 Ishino ..... 399/159

FOREIGN PATENT DOCUMENTS

JP 10-333393 12/1998
JP 2001-051467 2/2001

* cited by examiner

*Primary Examiner*—Sandra L Brase
(74) *Attorney, Agent, or Firm*—Gerald E. Hespos; Michael J. Porco

(57) ABSTRACT

There is provided a tandem color image forming apparatus and the like, which is capable of suppressing the generation of black spots during a continuous image forming process, even though a non-magnetic single-component developer is used and a cleaner-less type is adopted. The color image forming apparatus is a tandem type that includes a plurality of image carriers and a cleaner-less type that does not include a blade cleaner, wherein the resistance per square centimeter of a base body of an image carrier using for at least a black developer among the plurality of image carriers, or the resistance per square centimeter of the base body through an intermediate layer is set in a range of $1\times10^5$ to $1\times10^8\Omega$ or more.

5 Claims, 5 Drawing Sheets

COLOR IMAGE FORMING APPARATUS AND COLOR IMAGE FORMING METHOD

BACKGROUND OF THE PRESENT INVENTION

1. Field of the Invention

The present invention relates to a tandem color image forming apparatus using a plurality of image carriers and a color image forming method. In particular, the present invention relates to a color image forming apparatus capable of effectively suppressing the generation of black spots even when a continuous image forming process is performed, and to a method of forming a color image using the same.

2. Description of the Related Art

In recent years, tandem color image forming apparatuses capable of forming high-quality color images at a high speed have come into widespread use.

The tandem color image forming apparatus includes a plurality of image forming units having image carriers using for each color developer, and in the image forming units, developer images using for each color developer are formed on the image carriers. Then, the developer images using for each color developer are overlapped on a recording material or an intermediate transfer body, thereby forming a color image.

Further, in the tandem color image forming apparatus, an organic photoconductor has been widely used as the image carrier since it has a high charging property and can stably support a developer even when an image forming process is performed at a high speed.

Meanwhile, when the organic photoconductor is used, an organic photoconductor using for a black developer is more likely to be worn away than organic photoconductors using for the other color developers since monochrome printing is frequently performed in the color image forming apparatus.

In order to solve the above problem, a color image forming apparatus has been disclosed in which only the image carrier using for the black developer is composed of an amorphous silicon photoconductor having high abrasion resistance (for example, see JP10-333393A).

More specifically, a color image forming apparatus has been disclosed in which only the image carrier using for the black developer is composed of an amorphous silicon photoconductor including an amorphous silicon carbide photoconductive layer with a predetermined thickness, organic photoconductors are used as image carriers using for the other color developers, and a difference between the charging potential of the amorphous silicon photoconductor and the charging potential of the organic photoconductors is 200 V or less.

However, when the amorphous silicon photoconductor disclosed in JP10-333393A is used, it is difficult to compensate for a reduction in the charging property. In addition to the charging property, since the amorphous silicon photoconductor has different exposure characteristics or transfer characteristics from the organic photoconductors, it is complicated and difficult to individually control these characteristics.

In addition, a color image forming apparatus has been disclosed which uses an organic photoconductor as the image carrier using for the black developer to improve the abrasion resistance thereof (for example, see JP2001-51467A).

More specifically, a color image forming apparatus has been disclosed in which a non-contact charging method is used for only the organic photoconductor using for the black developer, a photosensitive layer of the organic photoconductor using for the black developer is formed to have a relatively large thickness, or a binding resin of the photosensitive layer has a relatively large viscosity average molecular weight.

When the color image forming apparatus disclosed in JP2001-51467A is used, it is possible to improve the abrasion resistance of the photosensitive layer of the organic photoconductor using for the black developer. However, when a continuous image forming process is performed, filming is likely to occur in the organic photoconductor using for the black developer, which may cause black spots to be generated on a formed image.

More specifically, since the organic photoconductor using for the black developer is more frequently used than organic photoconductors using for the other color developers and is generally arranged in the vicinity of a position where paper powder is generated, such as a transfer unit or a fixing unit, remaining toner or paper powder is likely to be adhered to the surface of the photosensitive layer, which may cause filming.

In particular, when a non-magnetic single-component developer produced by polymerization method is used as the developer and a cleaner-less type without a blade cleaner is adopted to perform a continuous image forming process, it is more difficult to suppress the occurrence of filming and the generation of black spots on a formed image in the organic photoconductor using for the black developer.

The inventors found that it was possible to effectively suppress the generation of black spots on a formed image, even when filming occurred in the image carrier, by setting the resistance per unit area of a base body of an image carrier using for at least a black developer, or the resistance per unit area of the base body through an intermediate layer in a predetermined range, in a tandem color image forming apparatus. The present invention has been made on the basis of the findings.

SUMMARY OF THE INVENTION

Accordingly, an object of the present invention is to provide a tandem color image forming apparatus and a method of forming a color image using the same capable of effectively suppressing the generation of black spots on a formed image during a continuous image forming process, even though a non-magnetic single-component developer is used and a cleaner-less type is adopted.

According to the present invention, there is provided a color image forming apparatus of a tandem type and a cleaner-less type without a blade cleaner. The color image forming apparatus includes a plurality of the image carriers on which black and color electrostatic latent images are formed, and the electrostatic latent images formed on the image carriers are developed by a non-magnetic single-component developer. The resistance per square centimeter of a base body of an image carrier, or the resistance per square centimeter of the base body through an intermediate layer using for at least a black developer among the plurality of image carriers is in a range of $1\times10^5$ to $1\times10^8\Omega$ on the condition that voltage applied is 100 V. Thus, it is possible to solve the above-mentioned problem with the color image forming apparatus.

That is, it is possible to effectively suppress the generation of black spots on a formed image, even when filming occurs in the image carrier due to a continuous image forming process, by setting the resistance per unit area of the base body of the image carrier (or the resistance per unit area of the base body through the intermediate layer of the image carrier) using for the black developer in which filming is likely to occur due to the influence of the frequency of use, in a predetermined range.

More specifically, it is possible to suppress the generation of a leakage current, for example, among a portion of the image carrier where filming occurs and a developing unit, a transfer unit, and a charging unit by setting the resistance per unit area of the base body of the image carrier (or the resistance per unit area of the base body of the image carrier through the intermediate layer) in a predetermined range. As a result, it is possible to effectively suppress the generation of black spots on a formed image.

When a non-magnetic single-component developer is used as the developer, in many cases, a cleaner-less type without a blade cleaner is generally adopted. Therefore, filming is more likely to occur in the image carrier. However, even in this case, according to the color image forming apparatus of the present invention, it is possible to effectively suppress the generation of black spots on a formed image.

In the present invention, the term "color" in the "color and black" mainly means three colors, that are, cyan, magenta, and yellow, but is not limited thereto. The term "color" may mean one or two of the three colors or colors other than the three colors.

In the color image forming apparatus according to the present invention, preferably, the image carrier using for the black developer is a positive charging type organic photoconductor.

According to the above-mentioned structure, it is possible to further improve a charging property, as compared to an inorganic photoconductor, such as an amorphous silicon photoconductor. In addition, it is possible to reduce the amount of ozone generated during charging, as compared to a negative charging type image carrier.

Meanwhile, when the positive charging type image carrier is used, for example, paper powder is likely to be adhered to the surface of the image carrier, which may cause filming. However, even in this case, according to the color image forming apparatus of the present invention, it is possible to effectively suppress the generation of black spots on a formed image.

In the color image forming apparatus according to the present invention, preferably, the base body of the image carrier using for the black developer is made of an aluminum substrate.

According to the above-mentioned structure, it is possible to easily adjust the resistance per unit area of the base body (or the resistance per unit area of the base body through the intermediate layer) to a predetermined range.

In the color image forming apparatus according to the present invention, preferably, an alumite layer is formed on the surface of the base body of the image carrier using for the black developer.

According to the above-mentioned structure, it is possible to directly modify the surface of the base body and easily adjust the resistance per unit area of the base body to a predetermined range.

In the color image forming apparatus according to the present invention, preferably, the alumite layer has a thickness of 1 to 50 μm.

According to the above-mentioned structure, it is possible to uniformly and stably form an alumite layer having a predetermined resistance.

In the color image forming apparatus according to the present invention, preferably, the intermediate layer of the image carrier using for the black developer contains inorganic fine particles and a binding resin.

According to the above-mentioned structure, it is possible to easily adjust the resistance per unit area of the base body through the intermediate layer to a predetermined range, regardless of the property of a material forming the base body.

In the color image forming apparatus according to the present invention, preferably, the inorganic fine particles are titanium oxide particles.

According to the above-mentioned structure, it is possible to easily adjust the resistance per unit area of the base body through the intermediate layer to a predetermined range.

In the color image forming apparatus according to the present invention, preferably, the resistance per square centimeter of a base body of each of the image carriers using for color developers or the resistance per square centimeter of the base body through the intermediate layer of each of the image carriers using for color developers is $1\times10^4\Omega$ or less on the condition that voltage applied is 100 V.

According to the above-mentioned structure, in the image carriers using for color developers in which filming is fundamentally less likely to occur than the image carrier using for the black developer, it is possible to prevent the generation of black spots. In addition, it is possible to effectively move charge in the photosensitive layer and thus form a high-quality image.

In the color image forming apparatus according to the present invention, preferably, the base body of each of the image carriers using for the color developers is made of an aluminum substrate, and an alumite layer and an intermediate layer are not formed on the surface of the base body.

According to the above-mentioned structure, it is possible to prevent the generation of black spots and effectively move charge in the photosensitive layer. As a result, it is possible to form a high-quality image.

According to another aspect of the present invention, there is provided a method of forming a color image using any of the above-mentioned color image forming apparatus.

That is, the color image forming apparatus according to the present invention can effectively suppress the generation of black spots on a formed image, even when filming occurs in the image carrier using for, particularly, the black developer.

Therefore, it is possible to effectively suppress the generation of black spots even when a continuous image forming process is performed and thus stably obtain a high-quality image.

DETAILED DESCRIPTION OF THE PREFERRED EMBODIMENT

First Embodiment

A first embodiment is a color image forming apparatus of a tandem type and a cleaner-less type without a blade cleaner. The color image forming apparatus includes a plurality of image carriers on which black and color electrostatic latent images are formed, and the electrostatic latent images formed on the image carriers are developed by a non-magnetic single-component developer. The resistance per square centimeter of a base body of the surface of an image carrier, or the resistance per square centimeter of the surface of the base body through an intermediate layer using for at least a black developer among the plurality of image carriers is $1\times10^5$ to $1\times10^8\Omega$ or more on the condition that voltage applied is 100 V.

Hereinafter, components of a color image forming apparatus according to the first embodiment of the present invention will be individually described in detail.

1. Basic Structure

Figure 2:
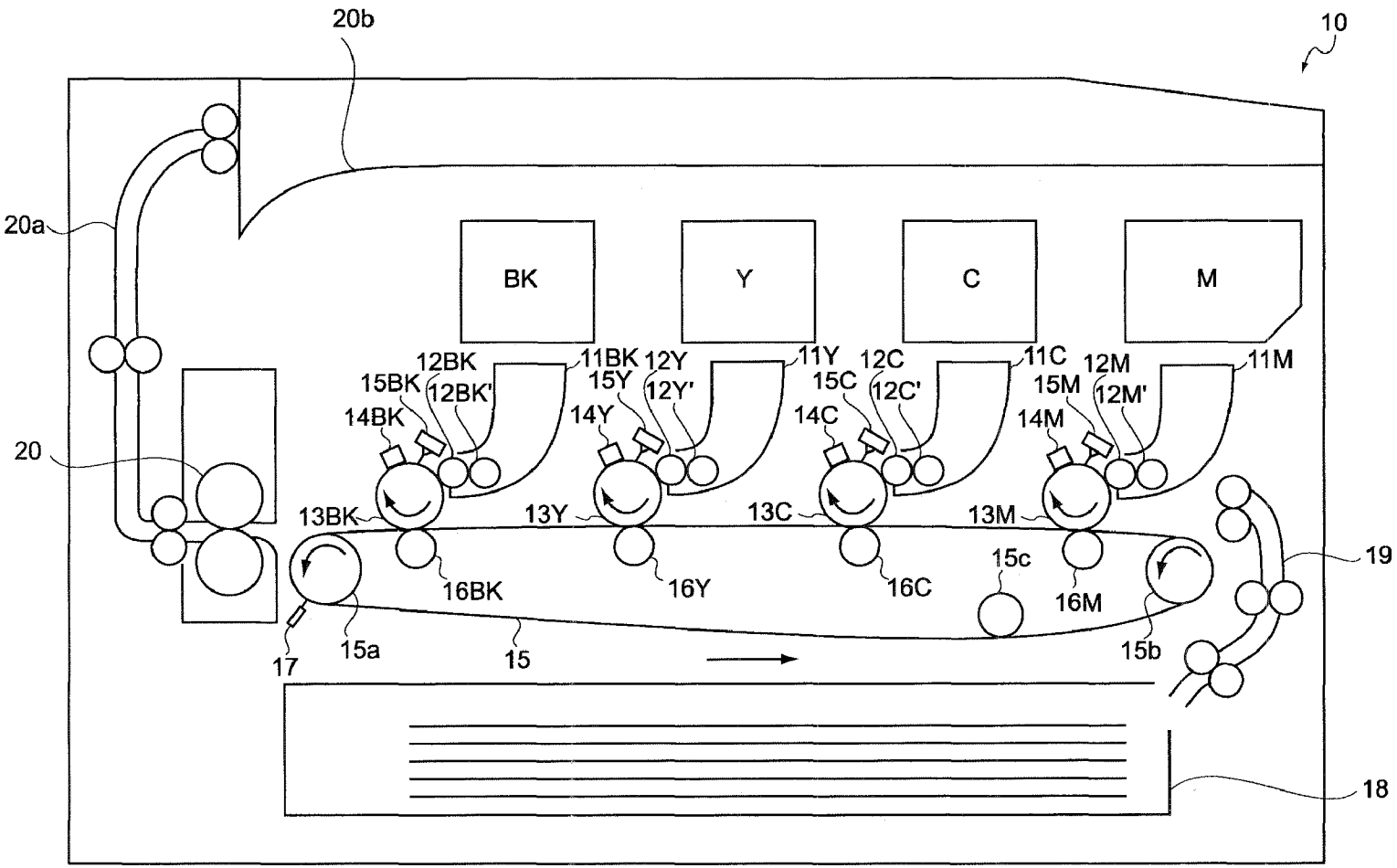
FIG. 2 is a diagram illustrating the structure of a color image forming apparatus according to the present invention.

FIG. 2 is a diagram illustrating an example of a tandem color image forming apparatus according to the present invention. A color image forming apparatus 10 includes an endless belt (transport belt) 15, and the endless belt 15 is configured to transport a recording sheet that is fed from a paper feeding cassette 18 to a fixing device 20. In addition, a magenta developing device 11M, a cyan developing device 11C, a yellow developing device 11Y, and a black developing device 11BK are arranged above the endless belt 15 along a direction in which the recording sheet is transported.

Further, image carriers 13M to 13BK are arranged so as to face developing rollers 12M to 12BK, respectively. In addition, charging devices 14M to 14BK that charge the surfaces of the image carriers 13M to 13BK and exposure devices 15M to 15BK that form electrostatic latent images on the surfaces of the image carriers 13M to 13BK are arranged in the vicinities of the image carriers 13M to 13BK, respectively.

Therefore, the electrostatic latent images formed on the image carriers 13M to 13BK using for the each color are developed by the developing devices 11M to 11BK using for the each color.

The image carriers using for the each color are arranged in the order shown in FIG. 2, and it is preferable that the magenta, cyan, yellow, and black image carriers be arranged in this order from the upstream side.

This arrangement makes it possible to prevent each of the image carriers from being contaminated with other color developers from the relationship between the frequencies of use of colors.

In particular, it is preferable that the image carrier using for a black developer that is most frequently used be arranged on the most downstream side.

Further, transfer devices 16M to 16BK that sequentially transfer color developer images on the recording sheet transported by the endless belt 15 are arranged so as to be respectively opposite to the image carriers 13M to 13BK with the endless belt 15 interposed therebetween.

2. Image Carrier

In this embodiment of the present invention, inorganic photoconductors, such as amorphous silicon photoconductors, can be used as the image carriers using for the colors including black. It is preferable to use organic photoconductors as the image carriers.

The reason is that the organic photoconductor has a high charging property and can effectively support a developer even when an image forming process is performed at a high speed, as compared to the inorganic photoconductor.

Therefore, an example in which the organic photoconductor is used as the image carrier will be described below.

(1) Basic Structure

Figure 3A:
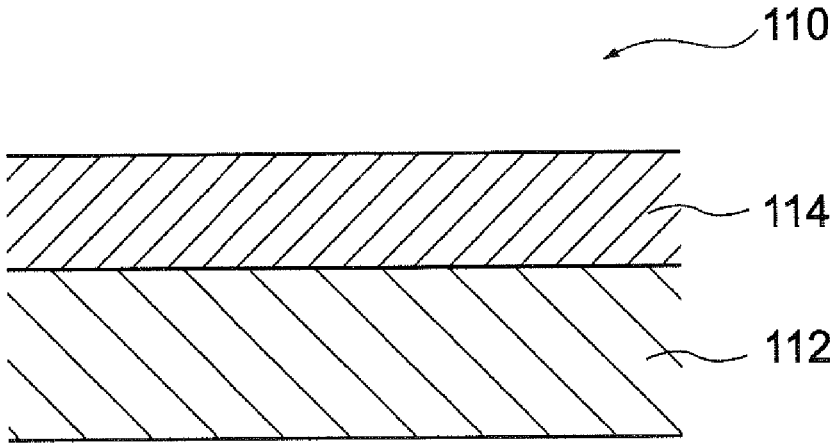
FIGS. 3A and 3B are diagrams illustrating the structure of a monolayer image carrier.

In the embodiment of the present invention, as shown in FIG. 3A, it is preferable that a monolayer image carrier 110 including a monolayer photosensitive layer 114 that is formed on the base body 112 and is made of a charge generating agent, a charge transfer agent, and a binding resin be used as the image carrier.

Figure 3B:
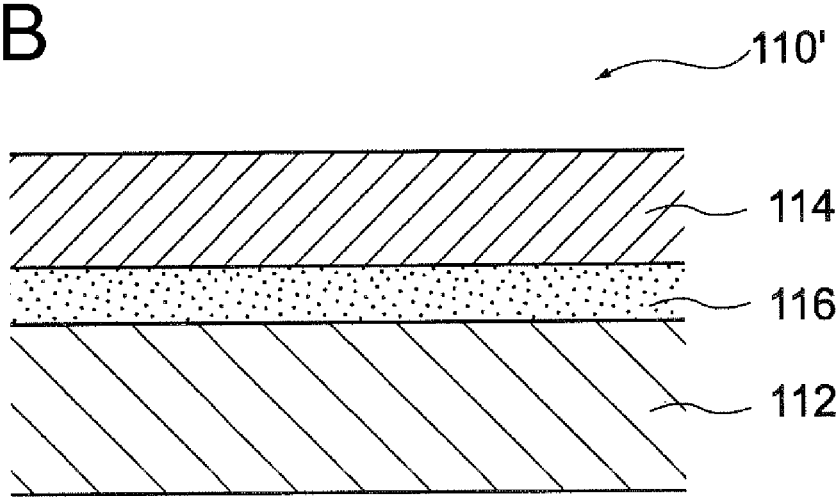

Alternatively, as shown in FIG. 3B, a monolayer image carrier 110' including the base body 112, the photosensitive layer 114, and an intermediate layer 116 interposed therebetween may be used as the image carrier.

Figure 4A:
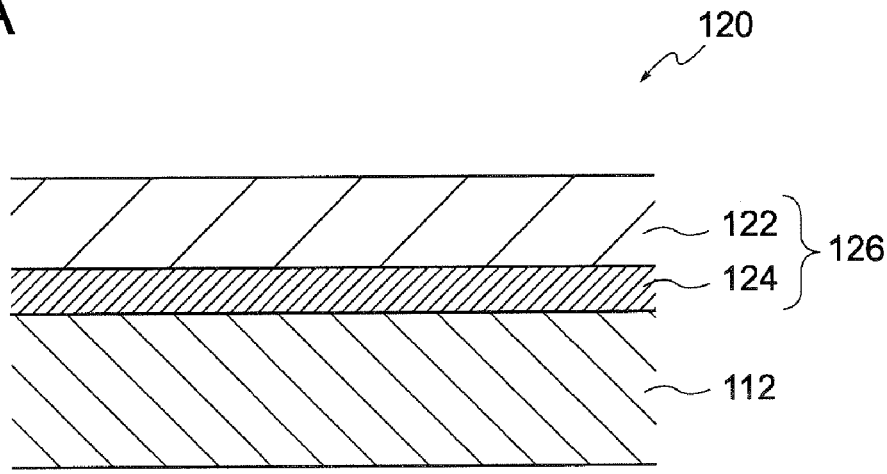
FIGS. 4A and 4B are diagrams illustrating the structure of a multilayer image carrier.

Further, as shown in FIG. 4A, it is also preferable that a multilayer image carrier 120 in which a multilayer photosensitive layer 126 including a charge generating layer 124 formed of a charge generating agent and a binding resin and a charge transfer layer 122 formed of a charge transfer agent and a binding resin is formed on the base body 112 may be used as the image carrier according to the present invention.

(2) Base Body (2)-1 Resistance

The color image forming apparatus according to the present invention is characterized in that the resistance per square centimeter of the base body (or the resistance per unit area of the base body through the intermediate layer) of the image carrier using for at least a black developer among a plurality of image carriers is in a range of $1\times10^5$ to $1\times10^8\Omega$ on the condition that voltage applied is 100 V.

The reason is as follows. When the resistance per unit area of the base body (or the resistance per unit area of the base body through the intermediate layer) of an image carrier using for the black developer in which filming is likely to occur due to the influence of the frequency of use is set in a predetermined range, it is possible to effectively suppress the generation of black dots on a formed image, even when filming occurs in the image carrier due to a continuous image forming process.

That is, it is possible to suppress the generation of a leakage current, for example, among a portion of the image carrier where the filming occurs and the developing unit, the transfer unit, and the charging unit by setting the resistance per unit area of the base body of the image carrier (or the resistance per unit area of the base body through the intermediate layer of the image carrier) in a predetermined range. As a result, it is possible to effectively suppress the generation of black spots on a formed image.

More specifically, if the resistance per unit area of the base body of the image carrier (or the resistance per unit area of the base body of the image carrier through the intermediate layer) is below of $1\times10^5\Omega$, the overall resistance of the image carrier is significantly decreased, and a leakage current is likely to be generated from the surface of the image carrier due to a voltage applied between the image carrier and the developing unit in order to develop an electrostatic latent image formed on the image carrier. In particular, in the case of an image carrier in which filming is likely to occur, such as an image carrier using for the black developer, since inorganic fine particles caused by the developer, such as titanium oxide particles, are contained in the filming, the leakage current is likely to be generated from the filming.

In a portion of the image carrier where the leakage current is generated, the charge state thereof is greatly changed, which causes black spots (in the case of the image carrier using for the black developer) to be generated on a formed image.

Meanwhile, if the resistance per unit area of the base body of the image carrier (or the resistance per unit area of the base body of the image carrier through the intermediate layer) is excessively large, it is difficult for charge to move in a photosensitive layer that is required to form an electrostatic latent image, and remaining charge in the photosensitive layer is likely to be stored.

Therefore, the resistance per unit area of the base body of the image carrier (or the resistance per unit area of the base body of the image carrier through the intermediate layer) is preferably set in a range of $1\times10^5$ to $5\times10^8\Omega$, more preferably, in a range of $1\times10^5$ to $1\times10^7\Omega$.

In the image carriers using for color developers, basically, it is not necessary to define the resistance of the base body. However, in order to form a high-quality image, it is preferable that the resistance per square centimeter of the base body of each of the image carriers, or the resistance per square centimeter of the base body through the intermediate layer of each of the image carriers is $1\times10^4\Omega$ or less on the condition that voltage applied is 100 V.

That is, when the resistance of the base body is set in the above-mentioned range, it is possible to prevent filming from occurring in the image carriers using for color developers, as compared to the image carrier using for the black developer, and thus it is possible to prevent the generation of black spots. In addition, it is possible to effectively move charge in the photosensitive layer and thus form a high-quality image by setting the resistance of the base body in the above-mentioned range.

Therefore, the resistance per square centimeter of the base body of the image carrier (or the resistance per unit area of the base body of the image carrier through the intermediate layer) is preferably set in a range of $1\times10^{-2}$ to $1\times10^4\Omega$ on the condition that voltage applied is 100 V, more preferably, $1\times10^{-1}$ to $1\times10^3\Omega$, in consideration of the frequency of use of color developers.

Further, when the resistance of the base body in each of the image carriers using for the color developers is set in the above-mentioned range, it is preferable that the base body is made of an aluminum substrate and an alumite layer and an intermediate layer, which will be described below, be not formed on the surface of the base body.

The reason is as follows. Considering the general frequency of use of color developers, even when a photosensitive layer is directly formed on a conductive aluminum base body, black spots are hardly generated. In contrast, this structure contributes to a high-quality image forming.

However, when filming is likely to occur in the image carriers using for the color developers due to a high frequency of use of the color developers, it is possible to suppress the generation of spots (each color spot) by defining the resistance of the base body of each of the image carriers, similar to the image carrier using for the black developer.

The resistance (Ω) per square centimeter of the base body of the image carrier (or the resistance per unit area of the base body of the image carrier through the intermediate layer) on the condition that voltage applied is 100 V can be measured as follows.

That is, when the intermediate layer is not provided on the base body, a portion having an area of 1 $cm^2$ is cut out from the base body, which is called a sample piece. Then, a gold electrode is vapor-deposited on one surface of the sample piece, that is, one surface of the sample piece using for the surface of the base body. Finally, a power source, the gold electrode, and the base body are connected to each other by conducting wires, and a voltage of 100 V is applied thereto. Then, a current flowing therethrough at that time is measured by an amperemeter, thereby obtaining a resistance (Ω).

When the intermediate layer is provided on the base body, the resistance can be measured by the same method as that when the intermediate layer is not provided except that a voltage is applied through the intermediate layer.

The method of measuring the resistance will be described in the subsequent Examples.

Next, the relationship between the resistance per unit area of the base body of the image carrier or the resistance per unit area of the base body of the image carrier through the intermediate layer and the number of black spots generated will be described with reference to FIG. 1.

Figure 1:
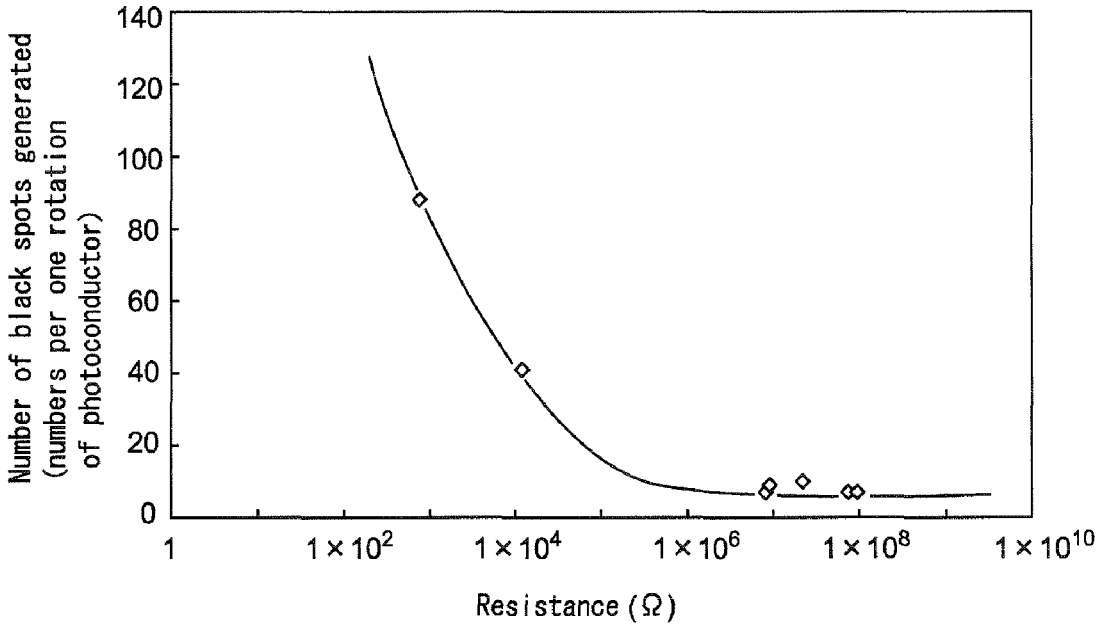
FIG. 1 is a diagram illustrating the relationship between the resistance per unit area of a predetermined base body and the number of black spots generated.

That is, in FIG. 1, the axis of abscissas indicates the resistance (Ω) per square centimeter of the base body (or the resistance per unit area of the base body through the intermediate layer) of the image carrier using for the black developer on the condition that voltage applied is 100 V, and the axis of ordinate indicates a characteristic curve representing the number of black spots generated on a formed image (black spots/one rotation of the photoconductor).

In addition, an aluminum base body is used as the base body, and the resistance of the base body (or the resistance per unit area of the base body through the intermediate layer) is adjusted by forming an alumite layer or an intermediate layer on the surface of the base body.

Further, aluminum base bodies without an alumite layer or an intermediate layer are used as the base body of the image carriers using for color developers, such as cyan, magenta, and yellow developers.

Furthermore, the number of black spots generated is measured under the following conditions: after 5000 color solid images formed by uniformly using the black, cyan, magenta, and yellow developers and 5000 monochrome solid images formed by using only the black developer are alternately printed, a white-paper image is printed, and the number of black spots in an area using for one rotation of the photoconductor (9.4 cm×21 cm) is counted by eyes.

Further, a color image forming apparatus of a tandem type and a cleaner-less type is used as the color image forming apparatus, and a non-magnetic single-component developer is used as the developer.

Details of the other conditions will be described in the subsequent Examples.

As can be seen from the characteristic curve, as the resistance per square centimeter of the base body of the image carrier using for the black developer (hereinafter, referred to as the resistance of a predetermined base body) increases, the number of black spots generated decreases.

More specifically, as the resistance of a predetermined base body increases from 1Ω to $1\times10^5\Omega$, the number of black spots generated is rapidly reduced from 100 or more to 20 or less.

Meanwhile, if the resistance of a predetermined base body is $1\times10^5\Omega$ or more, the number of black spots generated is stably maintained at 20 or less, regardless of a variation in the resistance of the base body.

Therefore, it can be seen that it is possible to effectively suppress the generation of black spots on a formed image by setting the resistance per square centimeter of the base body of the image carrier (or the resistance per square centimeter of the base body of the image carrier through the intermediate layer) using for the black developer to $1\times10^5\Omega$ or more on the condition that voltage applied is 100 V.

(2)-2 Materials

In the color image forming apparatus according to the present invention, it is preferable that the base body of the image carrier is made of an aluminum substrate.

The reason is as follows. When the base body is made of an aluminum substrate, it is possible to easily adjust the resistance per unit area of the base body (or the resistance per unit area of the base body through the intermediate layer) to a predetermined range.

That is, as described below, when the base body is made of an aluminum substrate, it is easy to adjust the resistance of the base body to a predetermined range by performing an alumite treatment on the surface of the base body or laminating an intermediate layer on the surface of the base body.

More specifically, it is preferable to use, for example, a JIS 1000 series aluminum alloy, a JIS 3000 series aluminum alloy, a JIS 5000 series aluminum alloy, and a JIS 6000 series aluminum alloy.

The base body may be formed of various conductive materials other than the aluminum alloy.

For example, the base body is formed of a metallic material, such as iron, copper, tin, platinum, silver, vanadium, molybdenum, chrome, cadmium, titanium, nickel, palladium, indium, stainless steel, or brass, a plastic material having the above-mentioned metallic material vapor-deposited or laminated thereon, or a glass material coated with aluminum iodide, alumite, tin oxide, or an indium oxide.

That is, the base body itself may have conductivity, a conductive material may be coated on the surface of the base body, or the base body may have sufficient mechanical strength in use.

Further, the base body may have any of a sheet shape or a drum shape according to the structure of the image forming apparatus for use.

(2)-3 Oxide Film

It is preferable to oxidize the surface of the base body of the image carrier using for at least the black developer to form an oxide film.

The reason is that it is possible to easily adjust the resistance per unit area of the base body to a predetermined range by oxidizing the surface of the base body to directly modify the surface of the base body.

In particular, it is preferable to oxidize the surface of the base body including aluminum to form an alumite layer thereon.

Further, it is preferable that the thickness of the alumite layer be set in a range of 1 to 50 μm.

The reason is that, when the thickness of the alumite layer is set in the above-mentioned range, it is possible to stably and uniformly form an alumite layer having a predetermined resistance.

That is, if the thickness of the alumite layer is below of 1 μm, it may be difficult to obtain a base body having a sufficient resistance. On the other hand, if the thickness of the alumite layer is above of 50 μm, the resistance of the base body may become excessively large.

Therefore, the thickness of the alumite layer is preferably set in a range of 2 to 30 μm, more preferably, in a range of 5 to 10 μm.

For example, the following method may be used to form the alumite layer on the base body including aluminum: a method of performing an anodizing process in an acid solution, sulfuric acid, oxalic acid, chromic acid, or boric acid to form an anodic oxide film and further performing a sealing process on the anodic oxide film.

(2)-4 Intermediate Layer

Figure 4B:
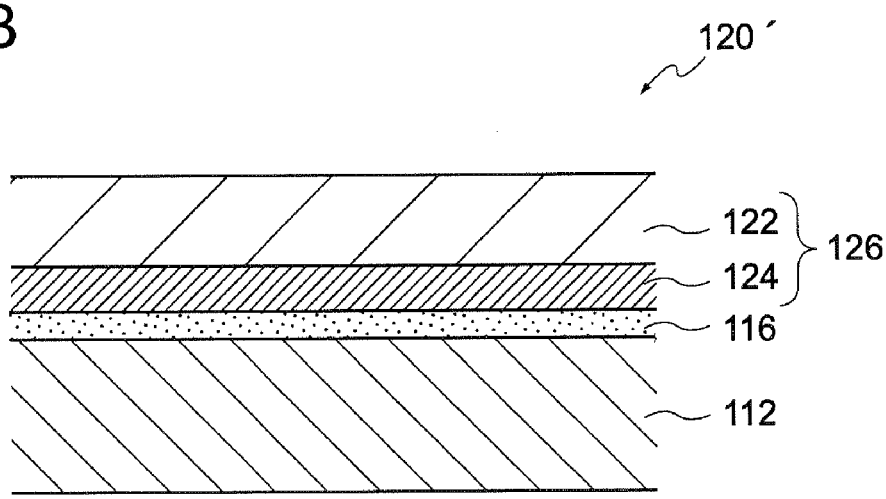

As shown in FIGS. 3B and 4B, it is preferable that the intermediate layer 116 containing, for example, a binding resin and inorganic fine particles be provided on the base body 112 of the image carrier using for at least the black developer and the resistance per unit area of the base body 112 through the intermediate layer 116 be set in a predetermined range.

Next, intermediate layer forming conditions will be described.

(i) Binding Resin (i)-1 Kind

It is preferable that, for example, at least one of polyamide resin, polyvinyl alcohol resin, polyvinyl butyral resin, polyvinyl formal resin, vinyl acetate resin, phenoxy resin, polyester resin, and acrylic resin be used as the binding resin.

Further, particularly, it is preferable to use polyamide resin among the above-mentioned binding resins.

The reason is that, when the polyamide resin is used as the binding resin, it is possible to improve adhesion among the intermediate layer, the base body, and the photosensitive layer and it is also possible to improve the dispersibility of inorganic fine particles contained in order to adjust the resistance of the intermediate layer.

Furthermore, it is preferable to use an alcohol-soluble polyamide resin as the polyamide resin since it is soluble by a solvent. Specifically, it is preferable to use copolymer nylon, which is a copolymer of Nylon 6, Nylon 66, Nylon 610, Nylon 11, or Nylon 12, or modified nylon obtained by chemically modifying nylon, such as N-alkoxymethyl-modified nylon or N-alkoxyethyl-modified nylon.

(i)-2 Number Average Molecular Weight

It is preferable that the number average molecular weight of the binding resin be set in a range of 1,000 to 50,000.

The reason is that, when the number average molecular weight of the binding resin is set in the above-mentioned range, it is possible to form the intermediate layer with a uniform thickness and, when the intermediate layer contains, for example, inorganic fine particles, it is possible to improve the dispersibility of the inorganic fine particles.

That is, if the number average molecular weight of the binding resin is above of 1,000, the viscosity of an application liquid for forming the intermediate layer is sharply lowered, which makes it difficult to form an intermediate layer with a uniform thickness, or mechanical strength, film forming ability, or adhesion may be sharply reduced. On the other hand, when the number average molecular weight of the binding resin is above of 50,000, the viscosity of the application liquid for forming the intermediate layer sharply increases, which makes it difficult to control the thickness of the intermediate layer, or the resistance of the intermediate layer may be sharply increased.

Therefore, the number average molecular weight of the binding resin is preferably set in a range of 2,000 to 30,000, more preferably, 5,000 to 15,000.

The number average molecular weight of the binding resin can be converted into the molecular weight of polystyrene using gel permeation chromatography (GPC), or when the binding resin is a condensed resin, the number average molecular weight of the binding resin can be calculated from the degree of condensation thereof.

Even when viscosity average molecular weight in the above-mentioned range is used instead of the number average molecular weight, it is possible to obtain the same effects as described above.

(i)-3 Viscosity

It is preferable that the solution viscosity of the binding resin (under the conditions of 5 wt % of binding resin in a solvent in which ethanol/toluene=1/1 and 25° C.) be set in a range of 10 to 200 mPa·sec.

The reason is as follows. When the solution viscosity of the binding resin is above of 10 mPa·sec, the film forming ability of the intermediate layer is lowered. As a result, a thickness difference increases, the mechanical strength or the adhesion of the intermediate layer is sharply reduced, or the dispersibility of the inorganic fine particles is lowered. On the other hand, when the solution viscosity of the binding resin is above of 200 mPa·sec, it may be difficult to form an intermediate layer with a uniform thickness.

Therefore, the solution viscosity of the binding resin (5 wt % of binding resin in a solvent in which ethanol/toluene=1/1) is preferably set in a range of 30 to 180 mPa·sec, more preferably, 50 to 150 mPa·sec.

(i)-4 Amount of Hydroxyl Group

In the case of a film forming resin in which the binding resin has a hydroxyl group, it is preferable that the amount of hydroxyl group be set in a range of 10 to 40 mol %.

The reason is as follows. When the amount of hydroxyl group of the film forming resin is above of 10 mol %, the mechanical strength, film forming ability, or adhesion of the intermediate layer may be sharply reduced, or the dispersibility of inorganic fine particles may be lowered. On the other hand, when the amount of hydroxyl group of the film forming resin is above of 40 mol %, the film forming resin is likely to become a gel, or it may be difficult to form an intermediate layer with a uniform thickness.

Therefore, when a film forming resin having a hydroxyl group is used as the binding resin, the amount of hydroxyl group of the film forming resin is preferably set in a range of 20 to 38 mol %, more preferably, 25 to 35 mol %.

In addition, for example, polyvinyl butyral resin or polyvinyl formal resin may be used as the film forming resin having a hydroxyl group.

(ii) Inorganic Fine Particles

It is preferable that the intermediate layer contains the binding resin and inorganic fine particles.

The reason is that, when the intermediate layer contains the inorganic fine particles, it is possible to easily adjust the resistance per unit area of the surface of the base body through the intermediate layer to a predetermined range, regardless of the kind of material forming the base body.

That is, it is possible to easily adjust the resistance of the base body through the intermediate layer by adding inorganic fine particles having predetermined conductivity to the intermediate layer while changing the particle diameters or the amount of inorganic fine particles added.

For example, titanium oxide particles, antimony oxide particles, zinc oxide particles, or tin oxide particles may be used as the inorganic fine particles.

In particular, titanium oxide particles may be used as the inorganic fine particles.

The reason is that it is possible to easily adjust the resistance per unit area of the base body through the intermediate layer by adding the titanium oxide particles to the intermediate layer.

That is, the titanium oxide particles make it possible to more easily adjust the resistance of the intermediate layer from the viewpoint of the specific resistance or the diameter thereof.

Further, when the titanium oxide particles are subjected to surface treatment, it is possible to easily adjust the conductivity or the dispersibility thereof.

Furthermore, crystalline or amorphous titanium oxide particles may be used. In the case of the crystalline titanium oxide particles, any of anatase-type titanium oxide particles, rutile-type titanium oxide particles, and brookite-type titanium oxide particles may be used. In particular, it is preferable to use rutile-type titanium oxide particles.

(ii)-1 Average Primary Particle Diameter

It is preferable that the average primary particle diameter (hereinafter, referred to as the number average primary particle diameter) of the titanium oxide particles be set in a range of 5 to 30 nm.

The reason is that, when the average primary particle diameter of the titanium oxide particles is set in a range of 5 to 30 nm, it is possible to improve the dispersibility of the intermediate layer and thus make the resistance of the intermediate layer constant.

That is, if the average primary particle diameter of the titanium oxide particles is below of 5 nm, it is difficult to accurately produce the titanium oxide particles, and the particles are likely to be aggregated with each other. On the other hand, if the average primary particle diameter of the titanium oxide particles is above of 30 nm, the dispersibility of the intermediate layer is lowered. As a result, it is difficult to make the resistance of the intermediate layer constant.

Therefore, the average primary particle diameter of the titanium oxide particles is preferably set in a range of 10 to 20 nm, more preferably, 12 to 18 nm.

The average primary particle diameter of the titanium oxides can be measured by a combination of an electron microscope and an image processing device.

More specifically, for example, after a scanning electron microscope magnifies the titanium oxide particles to 30000 times, a CCD is used to capture to the enlarged microscope and data of the captured image is transmitted to a personal computer. Then, for example, general-purpose image processing software, such as WIN ROOF manufactured by MITANI CORPORATION), is used to calculate the number average particle diameter (major axis) of 100 or more arbitrary titanium oxide particles in the captured image, and the calculated number average particle diameter is used as the average primary particle diameter of the titanium oxide particles.

(ii)-2 Content

It is preferable that the content of the titanium oxide be set in a range of 150 to 350 parts by weight with respect to 100 parts by weight of binding resin.

The reason is that, when the content of the titanium oxide is set in the above-mentioned range, it is easy to adjust the resistance of the intermediate layer to a predetermined range and it is possible to improve the dispersibility of the titanium oxide particles.

That is, if the content of the titanium oxide is above of 150 parts by weight with respect to 100 parts by weight of binding resin, the resistance of the intermediate layer may become excessively large. On the other hand, if the content of the titanium oxide is above of 350 parts by weight with respect to 100 parts by weight of binding resin, the resistance of the intermediate layer may become excessively small, or the dispersibility of the titanium oxide particles may be lowered.

Therefore, the content of the titanium oxide is preferably set in a range of 180 to 320 parts by weight, more preferably, 200 to 300 parts by weight, with respect to 100 parts by weight of binding resin.

(ii)-3 Surface Treatment

It is preferable that a surface treatment using alumina, silica, and an organic silicon compound be performed on the titanium oxide.

The reason is that the surface treatment makes it possible to improve the dispersibility of the titanium oxide in the intermediate layer and adjust the resistance of the intermediate layer to an appropriate range.

That is, it is possible to improve the basic dispersibility of the titanium oxide in the intermediate layer by performing a surface treatment using alumina ($Al_2O_3$) and silica ($SiO_2$) on the titanium oxide.

In addition, it is possible to easily adjust the amount of organic silicon compound, which will be described below, for the surface treatment by performing the surface treatment using alumina and silica on the titanium oxide.

Further, it is possible to further improve the dispersibility of the titanium oxide by performing the surface treatment using the organic silicon compound, and it is possible to easily adjust the conductivity of the titanium oxide by changing the amount of surface treatment.

For example, any of the following materials may be preferably used as the organic silicon compound: an alkylsilane compound; an alkoxysilane compound; a vinyl-group-containing silane compound; a mercapto-group-containing silane compound; an amino-group-containing silane compound; and a polysiloxane compound, which is a condensation polymer of the above compounds. More specifically, it is preferable to use a siloxane compound, such as methyl hydrogen polysiloxane or dimethyl polysiloxane. It is more preferable to use methyl hydrogen polysiloxane.

Further, the content of alumina and silica is preferably set in a range of 1 to 30 parts by weight, more preferably, 5 to 20 parts by weight, with respect to 100 parts by weight of titanium oxide. In addition, the content of the organic silicon compound is preferably set in a range of 1 to 15 parts by weight, more preferably, 5 to 10 parts by weight with respect to 100 parts by weight of titanium oxide.

It has been known that, when the surface treatment using the above-mentioned organic silicon compound is performed on the titanium oxide, adhesion among the intermediate layer containing the titanium oxide subjected to the surface treatment, the base body, and the photosensitive layer is improved.

It is considered that this is because the organic silicon compound interacts with a polyamide resin to improve the aggregation of the polyamide resin and the organic silicon compound modifies the surface of the intermediate layer, like a primer.

Accordingly, it is possible to adjust the dispersibility and the conductivity of the titanium oxide and adjust the adhesion among the intermediate layer, the base body, and the photosensitive layer by performing the surface treatment using the organic silicon compound on the titanium oxide.

(iii) Additives it is preferable that the intermediate layer contains various kinds of additives (organic fine powder or inorganic fine powder), in addition to the above-mentioned titanium oxide, in order to prevent the generation of an interference pattern due to light scattering and improve dispersibility.

In particular, the preferable additives may include a white pigment, such as a zinc oxide, zinc flower, zinc sulfide, lead white, or lithopone, an inorganic pigment, serving as an extender, such as alumina, calcium carbonate, or barium sulfate, fluororesin particles, benzoguanamine resin particles, styrene resin particles.

When an additive, such as fine powder, is added, the particle diameter thereof is preferably set in a range of 0.01 to 3 μm. The reason is that, when the particle diameter is excessively large, the unevenness of the intermediate layer may increase, an electrically non-uniform portion is likely to be generated, or image quality may be lowered. On the other hand, when the particle diameter is excessively small, a sufficient light scattering effect may not be obtained.

When an additive, such as fine powder, is added, the content of the additive is preferably set in a range of 1 to 70 wt %, more preferably, 5 to 60 wt % with respect to the solid content of the intermediate layer.

Further, it is preferable to add a charge transfer agent to the intermediate layer. That is, when the charge transfer agent is added, it is possible rapidly move charge generated from the photosensitive layer to the base body, thereby stabilizing electric characteristics of the image carrier.

(iv) Manufacturing Method (iv)-1 Preparation of Application Liquid for Intermediate Layer When the intermediate layer is formed, it is preferable to add an additive, such as a titanium oxide, to a solution having a resin component dissolved therein, and disperse the additive in the solution to form an application liquid.

In this case, for example, any of the following solvents may be used for the application liquid: an alcohol-based solvent, such as methanol, ethanol, isopropanol, or butanol; aliphatic type hydrocarbon, such as n-hexane, octane, or cyclohexane; aromatic hydrocarbon, such as benzene, toluene, or xylene; halogenated hydrocarbon, such as dichloromethane, dichloroethane, chloroform, carbon tetrachloride, or chlorobenzene; an ether solvent, such as dimethylether, diethylether, tetrahydrofuran, ethylene glycol dimethylether, diethylene glycol dimethylether, 1,3-dioxolan, or 1,4-dioxane; a ketone solvent, such as acetone, methyl ethyl ketone, or cyclohexane; an ester solvent, such as acetic ether or acetic methyl; dimethylformaldehyde; dimethylformamide; and dimethylsulfoxide. These solvents may be used singly, or in combination of two or more of them may be mixed with each other.

Further, it is preferable to use a commonly known dispersing method using, for example, a roll mill, a ball mill, a vibratory ball mill, an atliter, a sand mill, a colloid mill, and a paint shaker. However, the present invention is not limited thereto.

When the application liquid for the intermediate layer is produced, it is preferable that a binding resin be dissolved and then mixed with the above-mentioned titanium oxide in a plurality of stages.

More specifically, a method of producing the application liquid for the intermediate layer may preferably include the following processes (A) and (B):

(A) a process of adding a titanium oxide to a binding resin solution obtained by dissolving 31 to 65 wt % of binding resin among the entire binding resin forming the intermediate layer, thereby obtaining a primary dispersion liquid; and (B) a process of dissolving 35 to 69 wt % of binding resin among the entire binding resin in the primary dispersion liquid, thereby obtaining an application liquid for the intermediate layer.

The reason is that, when the entire amount of binding resin, the entire amount of titanium oxide, and an organic solvent are mixed with in one stage, not in a plurality of stages, the contact ratio between the surfaces of the titanium oxide particles, and the resin and the organic solvent is likely to be non-uniform. Therefore, the surface of the titanium oxide in the application liquid for the intermediate layer may be modified, and the dispersibility of the titanium oxide may be lowered. In addition, when these components are mixed with each other in one stage and titanium oxide particles having an average primary particle diameter of 0.015 μm or less are used, the dispersibility of the titanium oxide particles may be sharply reduced.

In contrast, when the application liquid for the intermediate layer is produced by the two processes (A) and (B), first, in the process (A), since the density of the titanium oxide in the primary dispersion liquid is very high, it is easy to uniform the contact ratio between the resin and the surface of each of the titanium oxide particles and the contact ratio between the organic solvent and the surface of each of the titanium oxide particles. Therefore, in the subsequent process (B), the dispersibility of the titanium oxide particles in the entire amount of resin is maintained at a predetermined level. As a result, the preservation stability of the application liquid for the intermediate layer is improved, and it is possible to easily and stably form a predetermined intermediate layer.

Therefore, the amount of binding resin added in the process (A) is preferably set in a range of 35 to 60 wt %, more preferably, 40 to 55 wt %, with respect to the entire amount of binding resin.

(iv)-2 Method of Applying Application Liquid for Intermediate Layer

For example, any of the following methods may be used as a method of applying the application liquid for the intermediate layer: a dip coating method; a spray coating method; a bead coating method; a blade coating method and roller coating method. However, the present invention is not limited thereto.

It is preferable that, after the application liquid for the intermediate layer is applied, the application liquid for the intermediate layer be heated and dried at a temperature of 30 to 200° C. for 5 minutes to 2 hours in order to stably form the intermediate layer and a photosensitive layer.

(iv)-3 Surface Treatment of Titanium Oxide

For example, as a method of performing a surface treatment on the titanium oxide contained in the intermediate layer, it is preferable to use a dry method of mixing and dispersing alumina, silica, an organic silicon compound, and a titanium oxide with grinding machine, without using a solvent, thereby performing a surface treatment on the titanium oxide.

Further, a wet method may be preferably used which adds alumina, silica, and an organic silicon compound that are dissolved in an appropriate solvent to titanium oxide slurry, and stirs and dries them, thereby performing a surface treatment on the titanium oxide.

Of the dry method and the wet method, it is preferable to use the wet method since it can perform a more uniform surface treatment.

In the wet method, it is preferable to use a wet media dispersion type apparatus.

The reason is that the wet media dispersion type apparatus can perform a uniform surface treatment while effectively grinding and dispersing aggregated titanium oxide particles since it has a high particle dispersing performance.

For example, the wet media dispersion type apparatus is filled with media therein and is provided with a member capable of improving dispersibility, such as a stirring disk that can rotate at a high speed.

It is preferable to use balls or beads as the above-mentioned media, and it is more preferable to use beads as the media in order to perform a more uniform surface treatment.

Further, it is preferable that the beads be formed of, for example, alumina, glass, zircon, zirconia, steel, or front stone.

Furthermore, it is preferable that the diameter of the beads be set in a range of 0.3 to 2 mm.

(3) Photosensitive Layer

The photosensitive layer according to the present invention may be the monolayer photosensitive layer 114 shown in FIGS. 3A and 3B or the multilayer photosensitive layer 126 shown in FIGS. 4A and 4B. In the monolayer photosensitive layer, a charge generating agent, a charge transfer agent, and a binding resin are contained in one photosensitive layer. Therefore, it is possible to simplify the structure and a manufacturing method thereof. On the other hand, the multilayer photosensitive layer is formed by sequentially laminating a charge generating layer containing a charge generating agent and a charge transfer layer containing a charge transfer agent, and a charge generating function and a charge transport function are separated. Therefore, it is possible to use various materials forming each of the layers and improve the electric characteristics thereof.

(3)-1 Monolayer Photosensitive Layer

A material forming the monolayer photosensitive layer is not particularly limited. For example, the monolayer photosensitive layer may be formed of various known materials.

For example, a polycarbonate resin, a polyester resin, or a polyarylate resin may be used as the binding resin.

For example, phthalocyanine pigment, perilene pigment, or bisazo pigment may be used as the charge generating agent.

For example, a triphenylamine compound, a hydrazone compound, or an enamine compound may be used as a hole transfer agent.

For example, a quinone compound, a diphenoquinone compound, or a fluorenone compound may be used as an electron transfer agent.

It is preferable that the content of the charge generating agent be set in a range of 0.1 to 50 parts by weight with respect to 100 parts by weight of binding resin.

It is preferable that the content of the hole transfer agent and the content of the electron transfer agent be set in a range of 1 to 120 parts by weight with respect to 100 parts by weight of binding resin.

Further, the thickness of the photosensitive layer is preferably set in a range of 5 to 100 μm.

(3)-2 Multilayer Photosensitive Layer

A material forming the multilayer photosensitive layer is not particularly limited. For example, the multilayer photosensitive layer may be formed of various materials that can be used to form the monolayer photosensitive layer.

The content of the charge generating agent in the charge generating layer is preferably set in a range of 5 to 1000 parts by weight with respect to 100 parts by weight of binding resin in the charge generating layer.

Further, the content of the charge transfer agent in the charge transfer layer is preferably set in a range of 10 to 100 parts by weight with respect to 100 parts by weight of binding resin in the charge transfer layer.

The thickness of the charge generating layer is preferably set in a range of 0.1 to 5 μm, and the thickness of the charge transfer layer is preferably set in a range of 5 to 50 μm.

A method of manufacturing the monolayer and multilayer photosensitive layers is basically the same as that manufacturing the intermediate layer, and thus a description thereof will be omitted.

(3)-3 Charging Type

It is preferable that the image carrier according to this embodiment of the present invention be a positive charging type.

The reason is that, when a positive charging type image carrier is used, it is possible to reduce the amount of ozone generated during charging, as compared to a negative charging type image carrier.

Meanwhile, when the positive charging type image carrier is used, for example, paper powder is likely to be adhered to the surface of the image carrier, and filming is more likely to occur. However, even in this case, according to the color image forming apparatus of the present invention capable of defining the resistance of a base body in a predetermined image carrier, it is possible to effectively prevent the generation of black spots on a formed image.

3. Developing Device

Next, the developing device 11 according to this embodiment of the present invention will be described with reference to FIG. 5.

In the developing device 11 according to the present invention, a thin layer that is formed on the developing roller 12 and is made of a non-magnetic single-component developer comes into direct contact with the image carrier 13 to develop the electrostatic latent image formed on the image carrier 13.

In addition, the developing roller 12 can develop the electrostatic latent image while scraping away the non-transferred developer remaining on the image carrier 13. Therefore, a blade cleaner that scrapes away the non-transferred developer remaining on the image carrier 13 may be omitted.

Therefore, the color image forming apparatus according to the present invention adopts a cleaner-less structure in which the blade cleaner is not provided.

In the cleaner-less structure in which the blade cleaner is not provided, filming is more likely to occur in the image carrier. However, even in this case, according to the color image forming apparatus of the present invention capable of defining the resistance of a base body in a predetermined image carrier, it is possible to effectively suppress the generation of black spots on a formed image.

First, the developing device 11 according to the present invention includes a developing housing 31 having a developer made of a non-magnetic single-component toner accommodated therein. The developing housing 31 includes a stirring chamber 32 and a developing chamber 33. Two stirring units 34 and 35 are provided in the stirring housing 32. The stirring units triboelectrify the developer by stirring, and move the developer from the stirring chamber 32 to the developing chamber 33.

The developing roller 12 and a feed roller 36 are provided in the developing chamber 33. The developer moved from the stirring chamber 32 is moved to the surface of the developing roller 12 through the feed roller 36.

The feed roller 36 is provided in parallel to the developing roller 12 in the developing chamber 33 of the developing housing 31, and comes into pressure contact with the developing roller 12 in a developer holding area 37, which is a nip portion between the feed roller 36 and the developing roller 12. The feed roller 36 is rotated in the direction of an arrow, that is, in a direction from the upstream side to the downstream side in the developer holding area 37, which is the nip portion between the feed roller 36 and the developing roller 12.

It is preferable to apply a bias between the developing roller 12 and the feed roller 36 in order to effectively move the non-magnetic single-component developer.

Figure 5:
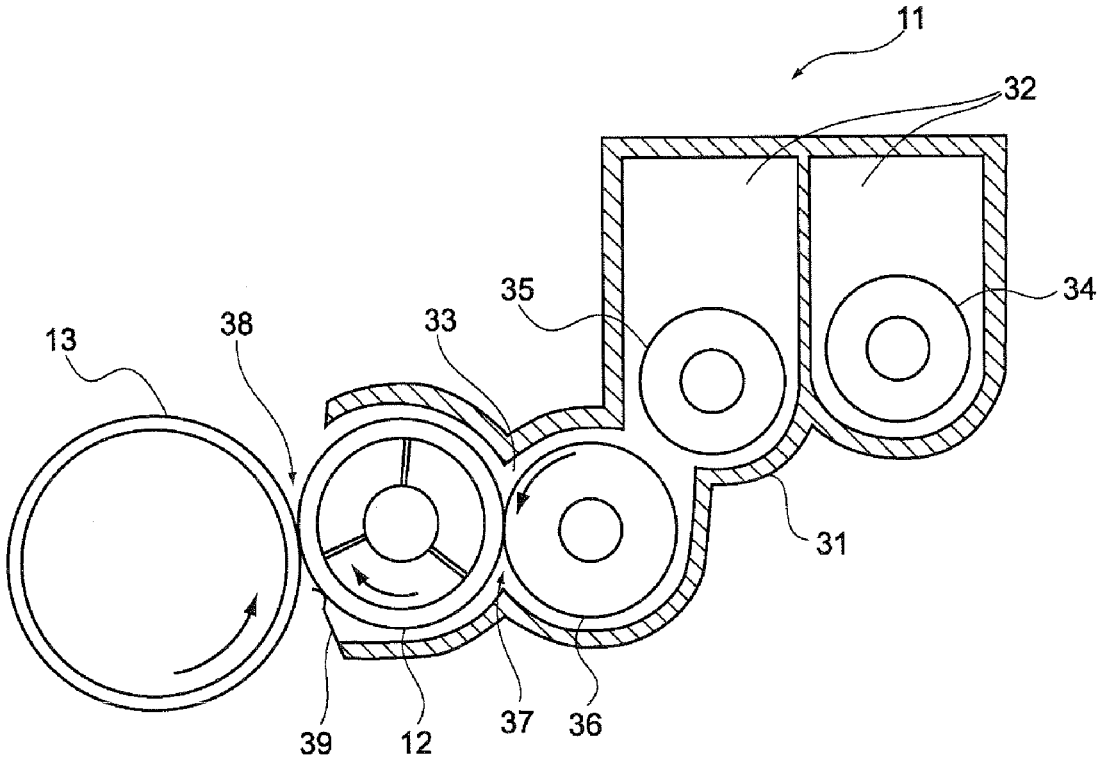
FIG. 5 is a diagram illustrating the structure of a developing device.

The developing roller 12 is exposed from an opening of the developing housing 31 that is formed on the left side of FIG. 5, and faces the image carrier 13. Therefore, the circumferential surface of the developing roller 12 comes into pressure contact with the circumferential surface of the image carrier 13 in a developing range, thereby forming a developing area 38.

The developing roller 12 is rotationally driven by a driving unit (not shown) in the direction of the arrow, that is, in a direction from the downstream side to the upstream side in the developing area 38, which is a contact portion between the developing roller 12 and the image carrier 13.

Therefore, in the developing area 38, the developer on the surface of the developing roller 12 is electrostatically adhered to the electrostatic latent image formed on the image carrier 13, and the image is developed.

It is preferable that the peripheral speed V1 of the image carrier 13, the peripheral speed V2 of the developing roller 12, and the peripheral speed V3 of the feed roller 36 satisfy V1<V2<V3.

The reason is as follows. When the peripheral speeds of the image carrier 13, the developing roller 12, and the feed roller 36 satisfy the above-mentioned relationship, it is possible to stably supply the developer to the image carrier 13 and effectively remove the non-transferred developer remaining on the image carrier 13 using the developing roller 12.

The developing device 11 includes a restricting blade 39 that is formed of a thin steel sheet having flexible elasticity and comes into pressure contact with the circumferential surface of the developing roller 12.

The restricting blade makes it possible to adjust a charge amount and the amount of developer on the developing roller 12.

It is preferable that the restricting blade 39 be formed of a stainless steel sheet or a spring steel sheet having a thickness of, for example, about 0.1 to 0.2 mm. The restricting blade 39 has a length that is substantially equal to that of the developing roller 12 in the longitudinal direction. The linear pressure of the restricting blade 39 coming into pressure contact with the developing roller 12 by the elasticity of a metallic material is preferably set in a range of 0.1 to 0.6 kg/mm or more.

4. Developer

The present invention is characterized in that a non-magnetic single-component developer is used.

The reason is that, when the non-magnetic single-component developer is used, the developer does not need to contain magnetic powder, which makes it possible to form a high-definition color image.

Unlike a magnetic developer or a two-component developer, it is not necessary to use a magnet roller. Therefore, it is possible to simplify the structure of the developing device and reduce the size thereof. In addition, as described with respect to the developing device, it is possible to construct a cleaner-less type color image forming apparatus without a blade cleaner.

Next, the basic structure of the non-magnetic single-component developer will be described.

It is preferable that a thermoplastic resin, such as a styrene resin, an acrylic resin, or a styrene-acryl resin, be used as the binding resin used for the toner particles. However, the present invention is not limited thereto.

Further, for example, any of the following materials may be used as a coloring agent added to the toner particles: carbon black; acetylene black; lamp black; aniline black; azo pigment; yellow iron oxide; ochre; nitro dye; oil-soluble dye; benzidine pigment; quinacridone pigment; and copper phthalocyanine pigment. However, the present invention is not limited thereto.

Further, for example, as the toner particles, it is preferable to use a charge control agent having a positive charging property, such as nigrosine, a quaternary ammonium salt chemical compound, or a resin type charge control agent obtained by binding an amine compound to resin.

It is preferable to add any of the following wax to the toner particles: polyethylene wax; polypropylene wax; fluororesin wax; Fischer Tropsch wax; paraffin wax; ester wax; montan wax; and rice wax.

In order to adjust the fluidity or the charging property of the developer, it is preferable to add inorganic fine particles, such as silica fine particles or titanium oxide fine particles, to the toner particles.

The volume average particle diameter of the toner particles is preferably set in a range of 6 to 10 μm, and the toner particles may be produced by a known method, such as a powder method or a polymerizing method.

Second Embodiment

A second embodiment relates to a method of forming a color image using the color image forming apparatus according to the first embodiment.

Hereinafter, the color image forming method according to the second embodiment will be described. In the second embodiment, a description of the same content as that in the first embodiment will be omitted.

First, as shown in FIG. 2, the image carriers 13M to 13BK of the image forming apparatus 10 are rotated at a predetermined process speed (peripheral speed) in the direction of an arrow, and the surfaces thereof are charged with a predetermined potential by the charging devices 14M to 14BK.

Then, the exposure devices 15M to 15BK expose the surfaces of the image carriers 13M to 13BK with light that is modulated according to image information using, for example, a reflecting mirror. The exposure causes color electrostatic latent images to be formed on the surfaces of the image carriers 13M to 13BK.

Then, the developing devices 11M to 11BK develop the electrostatic latent images. The developing devices 11M to 11BK have color (black, cyan, magenta, and yellow) developers accommodated therein, and the developers are adhered to the electrostatic latent images on the surfaces of the image carriers 13M to 13BK, thereby forming developer images.

The recording sheet is transported up to the lower part of the image carriers 13M to 13BK in a predetermined transfer and transport path. In this case, a predetermined transfer bias voltage is applied between the image carriers 13M to 13BK and the transfer devices 16M to 16BK to transfer the developer images on the recording sheet.

Then, the recording sheet having the developer images transferred thereto is separated from the surfaces of the image carriers 13M to 13BK by a separating unit (not shown), and is then transported to the fixing device 20 by the transport belt 15. Then, the fixing device 20 performs heating and pressurizing processes on the recording sheet to fix the developer images on the surface of the recording sheet, and the recording sheet is discharged to the outside of the image forming apparatus 10 by a discharge roller.

Meanwhile, after transferring the developer images, the image carriers 13M to 13BK are continuously rotated, and a non-transferred developer remaining on the surfaces of the image carrier 13M to 13BK is removed by the developing rollers 12M to 12BK provided in the developing devices 11M to 11BK.

That is, the developing rollers 12M to 12BK provided in the developing devices 11M to 11BK have a function of developing the electrostatic latent images formed on the surface of the image carriers 13M to 13BK and also serve as cleaners that remove the non-transferred developer remaining on the surfaces of the image carriers 13M to 13BK.

In addition, charge remaining on the surfaces of the image carriers 13M to 13BK may be removed by radiation of charge elimination light emitted from a charge eliminating unit (not shown).

EXAMPLES

Hereinafter, the present invention will be described in detail using Examples, but is not limited thereto.

Example 1

1. Manufacture of Image Carrier (1) Preparation of Base Body

An aluminum base body having a diameter of 30 mm, a length of 238.5 mm, and a thickness of 1.5 mm was prepared, and an alumite layer having a thickness of 7 μm was formed thereon.

That is, anodizing process was performed on the aluminum base body under the conditions of a nitric acid concentration of 180 g/liter, a temperature of 20° C., and an electrolytic voltage of 18 V for 20 minutes to form an anodic oxide film having a thickness of 6 μm.

Then, a sealing process was performed using a nickel acetate solution having a concentration of 6 g/liter at a temperature of 55° C. for 10 minutes.

Thereafter, an aluminum element tube was heated at a temperature of 140° C. for 60 minutes to form an alumite layer on the surface of the aluminum base body.

(2) Formation of Photosensitive Layer

Then, 3 parts by weight of non-metal phthalocyanine, serving as the charge generating agent, 50 parts by weight of hole transfer agent (HTM-1) represented by the following Chemical formula (1), 30 parts by weight of electron transfer agent (ETM-1) represented by the following Chemical formula (2), 100 parts by weight of polycarbonate resin having an average molecular weight of 30,000, serving as the binding resin, and 800 parts by weight of tetrahydrofuran, serving as a solvent, were contained in a vessel, thereby obtaining a mixture of them. Then, the mixture was mixed and dispersed by a ball mill for 50 hours to obtain an application liquid for a photosensitive layer.

Then, the obtained application liquid for a photosensitive layer was applied onto the above-mentioned base body by a dip coating method and then dried by hot air at a temperature of 100° C. for 40 minutes, thereby forming a photosensitive layer having a thickness of 25 μm. In this way, a monolayer image carrier was manufactured.

(1)

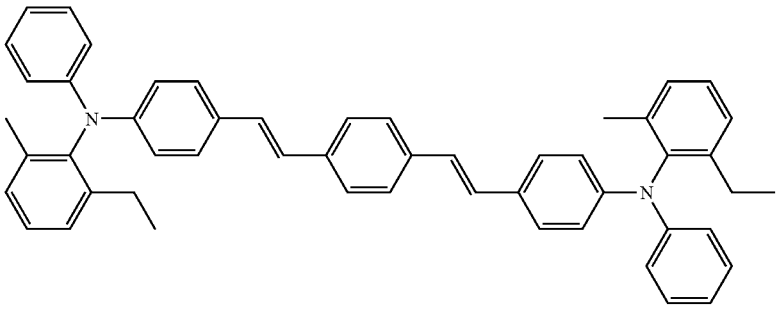

(HTM-1)

-continued

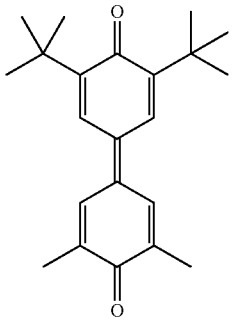

(ETM-1)

(2)

2. Measurement of Resistance

Another base body having the same structure as the above-mentioned base body was prepared, and the resistance thereof was measured.

That is, a portion having an area of 1 $cm^2$ (1 cm×1 cm) was cut out from the base body, which is called a sample piece. Then, a gold electrode having a thickness of 40 nm was sputter-deposited on one surface of the sample piece, that is, one surface of the sample piece having the alumite layer formed thereon by an ion sputtering apparatus, thereby obtaining a sandwich cell.

Then, the gold electrode of the obtained sandwich cell and the base body were connected to each other by a conducting wire, and a voltage of 100 V was applied. At that time, a current was measured by an amperemeter.

Finally, the resistance (Ω) of the base body was calculated from the obtained current value. The obtained results are shown in Table 1.

3. Evaluation of Number of Black Spots Generated

The obtained image carrier was mounted as an image carrier using for the black developer in a color image forming apparatus (remodeled KM-C3232, manufactured by Kyocera Mita Japan corp.) of a tandem type and a cleaner-less type. Image carriers having the same structure as the image carrier using for the black developer except that no alumite layer is formed on the base body were used as the other image carriers using for magenta, cyan, and yellow developers.

Then, after 5000 color solid images formed by uniformly using the black, cyan, magenta, and yellow developers and 5000 monochrome solid images formed by using only the black developer were alternately printed, a white-paper image was printed, and the number of black spots in an area using for one rotation of the image carrier (photoconductor) (9.4 cm×21 cm) was counted by eyes. In this case, the number of color spots generated by the image carries using for color developers other than the black developer was also counted by the same method as that counting the number of black spots. The obtained results are shown in Table 1.

The other image forming conditions are as follows:

a charging method: a scorotron charging method (charging potential: 800 V);

an exposure method: a laser light source exposure method (exposure intensity: 0.5 μJ/$cm^2$);

a developer: a non-magnetic single-component developer (polymerizing method); and a transfer method: an intermediate transfer method (belt transfer method)

Example 2

1. Manufacture of Image Carrier (1) Preparation of Base Body

An aluminum base body having the same structure as of Example 1 was prepared, except that no alumite layer was formed.

(2) Formation of Intermediate Layer

Then, 220 parts by weight of titanium oxide (MT-02, produced by Tayca Corporation, number average primary particle diameter: 10 nm), 1000 parts by weight of methanol, 250 parts by weight of butanol, and 100 parts by weight of Amilan CM8000 (Toray Industries Inc., a four-element copolymerized polyamide resin) were contained in a vessel, and then dispersed by a paint shaker for 10 hours, thereby obtaining an application liquid for an intermediate layer.

Then, the obtained application liquid for an intermediate layer passed through a filter with holes having a diameter of 5 μm and then applied on the above-mentioned base body by a dip coating method. Then, a heat treatment was performed on the application liquid at a temperature of 130° C. for 30 minutes to form an intermediate layer having a thickness of 2 μm.

(3) Formation of Photosensitive Layer

Then, a photosensitive layer was formed on the obtained intermediate layer by the same method as that in Example 1, thereby obtaining a monolayer image carrier.

2. Measurement of Resistance

An aluminum base body having only an intermediate layer having the same structure as the above-mentioned intermediate layer formed thereon was prepared, and the resistance of the base body through the intermediate layer was measured.

That is, a portion having an area of 1 $cm^2$ (1 cm×1 cm) was cut out from the base body having the intermediate layer formed thereon, which is called a sample piece. Then, a gold electrode having a thickness of 40 nm was sputter-deposited on one surface of the sample piece, that is, one surface of the sample piece having the intermediate layer formed thereon by an ion sputtering apparatus, thereby obtaining a sandwich cell.

Then, the gold electrode of the obtained sandwich cell and the base body were connected to each other by a conducting wire, and a voltage of 100 V was applied. At that time, a current was measured by an amperemeter.

Finally, the resistance (Ω) of the base body was calculated from the obtained current value. The obtained results are shown in Table 1.

3. Evaluation of Number of Black Spots Generated

The number of black spots generated and the number of color spots generated were counted by the same method as that in Example 1 except that the obtained image carrier was used. The obtained results are shown in Table 1.

Example 3

In Example 3, an image carrier was manufactured by the same method as that in Example 2 except that an intermediate layer was formed as follows. Then, the resistance of the base body was measured, and the number of black spots generated was counted. The obtained results are shown in Table 1.

That is, 220 parts by weight of titanium oxide (MT-02, produced by Tayca Corporation, number average primary particle diameter: 10 nm), 1200 parts by weight of ethanol, and 300 parts by weight of butanol were added to 100 parts by weight of copolymerized polyamide resin (VESTAMELT X4685, produced by Daicel/Degussa Co., Ltd.), and then the mixture was dispersed by a paint shaker for 10 hours, thereby obtaining an application liquid for an intermediate layer.

Then, the obtained application liquid for an intermediate layer passed through a filter with holes having a diameter of 5 μm and then applied on the same base body as that in Example 2 by a dip coating method. Then, a heat treatment was performed on the application liquid at a temperature of 130° C. for 30 minutes to form an intermediate layer having a thickness of 2 μm.

Example 4

In Example 4, an image carrier was manufactured by the same method as that in Example 2 except that an intermediate layer was formed as follows. Then, the resistance of the base body was measured, and the number of black spots generated was counted. The obtained results are shown in Table 1.

That is, 220 parts by weight of titanium oxide (SMT-02, produced by Tayca Corporation, number average primary particle diameter: 10 nm), 1200 parts by weight of ethanol, and 300 parts by weight of butanol were added to 100 parts by weight of copolymerized polyamide resin (VESTAMELT X4685, produced by Daicel/Degussa Co., Ltd.), and then the mixture was dispersed by a paint shaker for 10 hours, thereby obtaining an application liquid for an intermediate layer.

Then, the obtained application liquid for an intermediate layer passed through a filter with holes having a diameter of 5 μm and then applied on the above-mentioned base body by a dip coating method. Then, a heat treatment was performed on the application liquid at a temperature of 130° C. for 30 minutes to form an intermediate layer having a thickness of 2 μm.

Example 5

In Example 5, an image carrier was manufactured by the same method as that in Example 2 except that an intermediate layer was formed as follows. Then, the resistance of the base body was measured, and the number of black spots generated was counted. The obtained results are shown in Table 1.

That is, 220 parts by weight of titanium oxide (SMT-02, produced by Tayca Corporation, number average primary particle diameter: 10 nm), 1000 parts by weight of methanol, 250 parts by weight of butanol, and 100 parts by weight of Amilan CM8000 (Toray Industries Inc., a four-element copolymerized polyamide resin) were contained in a vessel, and then dispersed by a paint shaker for 10 hours, thereby obtaining an application liquid for an intermediate layer.

Then, the obtained application liquid for an intermediate layer passed through a filter with holes having a diameter of 5 μm and then applied on the above-mentioned base body by a dip coating method. Then, a heat treatment was performed on the application liquid at a temperature of 130° C. for 30 minutes to form an intermediate layer having a thickness of 2 μm.

Comparative Example 1

In Comparative example 1, an image carrier was manufactured by the same method as that in Example 2 except that no intermediate layer was formed. Then, the number of black spots generated was counted. The obtained results are shown in Table 1.

In Comparative example 1, since a base body was a conductor, the measurement of the resistance of the base body was omitted.

Comparative Example 2

In Comparative example 2, an image carrier was manufactured by the same method as that in Example 2 except that an intermediate layer having a thickness of 0.8 μm was formed. Then, the resistance of the base body was measured, and the number of black spots generated was counted. The obtained results are shown in Table 1.

Comparative Example 3

In Comparative example 3, an image carrier was manufactured by the same method as that in Example 2 except that an intermediate layer having a thickness of 0.2 μm was formed. Then, the resistance of the base body was measured, and the number of black spots generated was counted. The obtained results are shown in Table 1.

Comparative Example 4

In Comparative example 4, an image carrier was manufactured by the same method as that in Comparative example 1 except that a color image forming apparatus was provided with a cleaning device, a blade cleaner come into contact with an image carrier, and a developing device for a non-magnetic single-component developer was replaced with a developing device for a two-component developer.

Then, the number of black spots generated was counted. The obtained results are shown in Table 1.

TABLE 1

| | Base body | | | | | | Evaluation | | | |
|---|---|---|---|---|---|---|---|---|---|---|
| | Black | | | Colors | | | Black | Cyan | Magenta | Yellow |
| | Alumite layer | Intermediate layer | Resistance (Ω) | Alumite layer | Intermediate layer | Resistance (Ω) | Number of color spots generated | | | |
| Example 1 | Good | Bad | $8.2 \times 10^6$ | Bad | Bad | None | 7 | 4 | 3 | 3 |
| Example 2 | Bad | Good | $2.2 \times 10^7$ | | | | 10 | 5 | 3 | 5 |
| Example 3 | Bad | Good | $7.5 \times 10^7$ | | | | 7 | 5 | 3 | 3 |
| Example 4 | Bad | Good | $9.5 \times 10^7$ | | | | 7 | 6 | 4 | 5 |
| Example 5 | Bad | Good | $9.1 \times 10^6$ | | | | 9 | 5 | 3 | 3 |
| Comparative Example 1 | Bad | Bad | None | | | | 121 | 5 | 4 | 5 |
| Comparative Example 2 | Bad | Good | $1.2 \times 10^4$ | | | | 41 | 5 | 3 | 5 |
| Comparative Example 3 | Bad | Good | $7.5 \times 10^2$ | | | | 88 | 5 | 3 | 5 |
| Comparative Example 4 | Bad | Bad | None | | | | 6 | 5 | 3 | 3 |

INDUSTRIAL APPLICABILITY

According to the color image forming apparatus and the method of forming a color image using the same of the present invention, in a tandem color image forming apparatus, even when filming occurs in the image carrier, it is possible to effectively suppress the generation of black spots on a formed image by setting the resistance per unit area of the surface of the base body of an image carrier using for at least a black developer or the resistance per unit area of the base body through the intermediate layer in a predetermined range.

As a result, even when a continuous image forming process is performed, it is possible to effectively suppress the generation of black spots on a formed image, even though a non-magnetic single-component developer is used and a cleaner-less type is adopted.

Therefore, it is expected that the color image forming apparatus and the method of forming a color image using the same according to the present invention will contribute to acquiring a high quality image forming apparatus and reducing the size thereof.

What is claimed is:

1. A color image forming apparatus of a tandem type and a cleaner-less type without a blade cleaner, comprising:

a plurality of image carriers on which black and color electrostatic latent images are formed, wherein the electrostatic latent images formed on the image carriers are developed by a non-magnetic single-component developer, a base body of the plurality of image carriers is made of an aluminum substrate, an alumite layer or an intermediate layer is formed on the base body of the image carrier used for the black developer, the alumite layer or the intermediate layer is not formed on the base body of each of the image carriers used for color developers, the resistance per square centimeter of the base body including the alumite layer or the intermediate layer of the image carrier used for the black developer is in a range of $1\times10^5$ to $1\times10^8\Omega$ on the condition that voltage applied is 100 V, and the resistance per square centimeter of the base body of each of the image carriers used for color developers is $1\times10^4\Omega$ or less on the condition that voltage applied is 100 V.

2. The color image forming apparatus according to claim 1, wherein the image carrier used for the black developer is a positive charging type organic photoconductor.

3. The color image forming apparatus according to claim 1, wherein the alumite layer has a thickness in a range of 1 to 50 μm.

4. The color image forming apparatus according to claim 1, wherein the intermediate layer of the image carrier used for the black developer contains inorganic fine particles and a binding resin.

5. The color image forming apparatus according to claim 4, wherein the inorganic fine particles are titanium oxide particles.

* * * * *